US012098643B2

(12) United States Patent
Vincent et al.

(10) Patent No.: US 12,098,643 B2
(45) Date of Patent: Sep. 24, 2024

(54) CHEVRON GROOVED MATEFACE SEAL

(71) Applicant: Raytheon Technologies Corporation, Farmington, CT (US)

(72) Inventors: Tyler G. Vincent, Portland, CT (US); Daniel Carlson, East Hampton, CT (US)

(73) Assignee: RTX CORPORATION, Farmington, CT (US)

( * ) Notice: Subject to any disclaimer, the term of this patent is extended or adjusted under 35 U.S.C. 154(b) by 501 days.

(21) Appl. No.: 17/196,458

(22) Filed: Mar. 9, 2021

(65) Prior Publication Data

US 2022/0290573 A1 Sep. 15, 2022

(51) Int. Cl.
*F01D 11/00* (2006.01)
*F01D 9/04* (2006.01)

(52) U.S. Cl.
CPC ..... *F01D 11/005* (2013.01); *F01D 9/041* (2013.01); *F01D 9/042* (2013.01)

(58) Field of Classification Search
CPC ..... F01D 11/00; F01D 11/005; F01D 11/006; F01D 9/00; F01D 9/02; F01D 9/04; F01D 9/041; F01D 9/042; F05D 2240/55; F16J 15/02
See application file for complete search history.

(56) References Cited

U.S. PATENT DOCUMENTS 3,947,145 A * 3/1976 Michel ..... F01D 11/005 415/138
3,986,789 A * 10/1976 Pask ..... F01D 11/005 415/189
5,531,457 A 7/1996 Tibbott et al.
6,261,053 B1 7/2001 Anderson et al.
6,343,912 B1 * 2/2002 Manteiga ..... F01D 9/042 415/138
8,845,285 B2 9/2014 Weber et al.
9,581,036 B2 2/2017 Dipankar
2013/0177383 A1 * 7/2013 Winn ..... F01D 11/005 415/173.1
2014/0341720 A1 * 11/2014 Pal ..... F01D 11/006 415/170.1
2016/0319686 A1 11/2016 Shi et al.
2020/0149418 A1 * 5/2020 Whittle ..... F01D 5/282

OTHER PUBLICATIONS

European Search Report for European Patent Application No. 22161150.2 mailed Aug. 8, 2022.

* cited by examiner

*Primary Examiner* — Elton K Wong
(74) *Attorney, Agent, or Firm* — Carlson, Gaskey & Olds, P.C.

(57) ABSTRACT

A flow path component assembly includes a flow path component that has a plurality of segments that extend circumferentially about an axis. At least one of the segments have a first radial side and a second radial side and extend from a first circumferential side to a second circumferential side. A mateface seal is arranged on the first radial side near the first circumferential side. The mateface seal has a v-shaped groove.

20 Claims, 5 Drawing Sheets

CHEVRON GROOVED MATEFACE SEAL

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

The compressor or turbine sections may include vanes mounted on vane platforms. Seals may be arranged between matefaces of adjacent components to reduce leakage to the high-speed exhaust gas flow.

SUMMARY OF THE INVENTION

In one exemplary embodiment, a flow path component assembly includes a flow path component that has a plurality of segments that extend circumferentially about an axis. At least one of the segments have a first radial side and a second radial side and extend from a first circumferential side to a second circumferential side. A mateface seal is arranged on the first radial side near the first circumferential side. The mateface seal has a v-shaped groove.

In a further embodiment of any of the above, the first radial side is a radially outer side.

In a further embodiment of any of the above, the mateface seal has a plurality of v-shaped grooves.

In a further embodiment of any of the above, the plurality of v-shaped grooves are evenly spaced from one another.

In a further embodiment of any of the above, the v-shaped groove is formed from a first leg and a second leg that meet at a point.

In a further embodiment of any of the above, the first and second legs have a same length as one another.

In a further embodiment of any of the above, the point is centered on the mateface seal in a circumferential direction.

In a further embodiment of any of the above, the v-shaped groove is arranged in a side of the mateface seal that abuts the first radial side.

In a further embodiment of any of the above, cooling air is configured to flow through the v-shaped groove.

In a further embodiment of any of the above, the mateface seal is a metallic material.

In a further embodiment of any of the above, a mateface seal is arranged between each of the plurality of segments about the axis.

In a further embodiment of any of the above, the platform is a vane platform.

In a further embodiment of any of the above, the at least one segment is formed from a ceramic material.

In another exemplary embodiment, a turbine section for a gas turbine engine includes a plurality of vanes arranged circumferentially about an engine axis. Each vane has a platform. Each of the platforms have a first radial side and a second radial side and extend from a first circumferential side to a second circumferential side. A mateface seal is arranged on the first radial side near the first circumferential side of a first platform and a second circumferential side of a second platform. The mateface seal has at least a v-shaped groove.

In a further embodiment of any of the above, the mateface seal has a plurality of v-shaped grooves.

In a further embodiment of any of the above, the v-shaped groove is arranged such that a point of the v-shape points in a direction of core air flow.

In a further embodiment of any of the above, the point is centered on the mateface seal in a circumferential direction.

In a further embodiment of any of the above, the first radial side is a radially outer side.

In a further embodiment of any of the above, cooling air is configured to flow through the v-shaped groove to a gap between the first circumferential side of the first platform and the second circumferential side of the second platform.

In a further embodiment of any of the above, at least one of the platforms is formed from a ceramic material.

DETAILED DESCRIPTION

Figure 1:
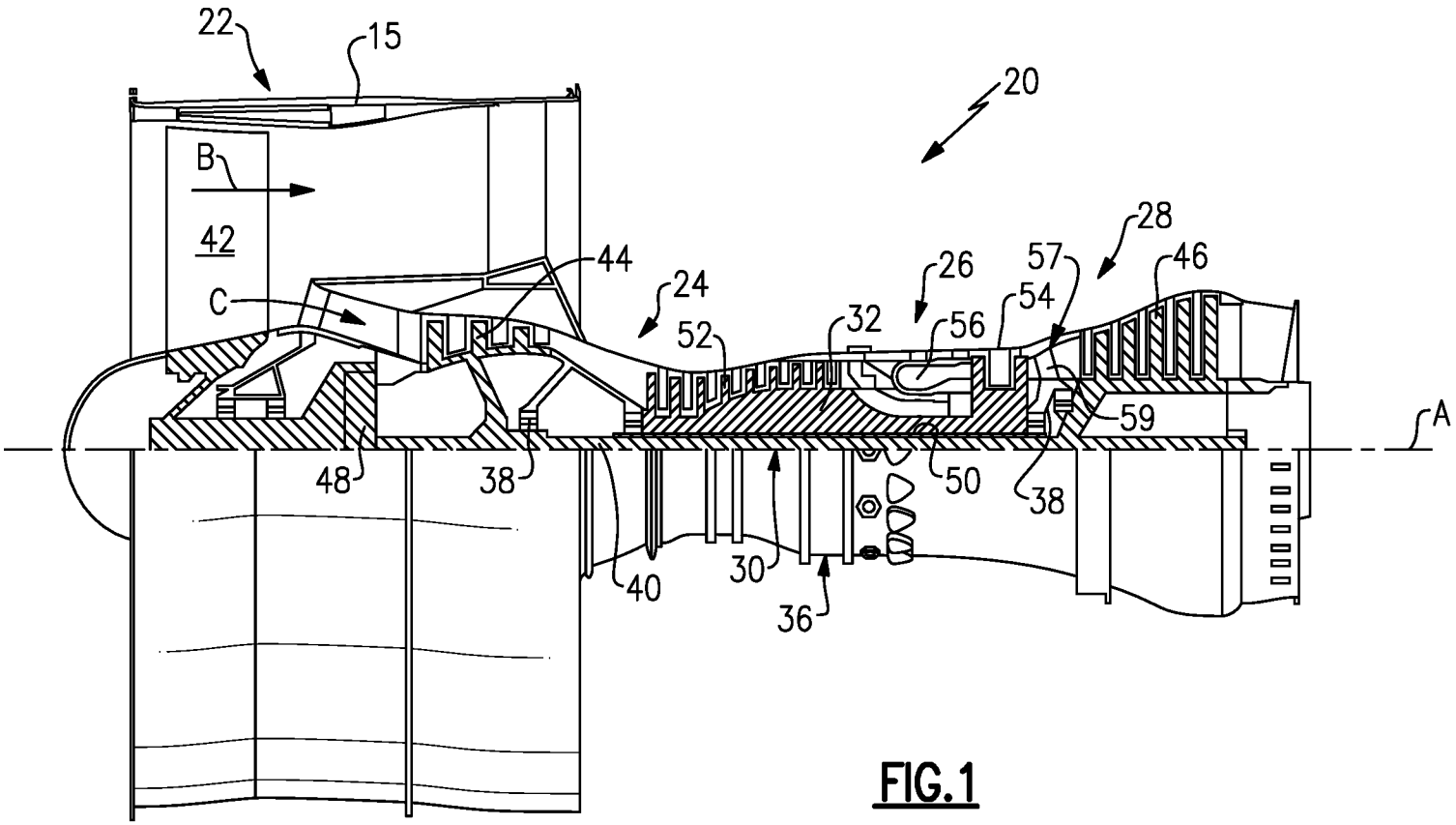
FIG. 1 schematically illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
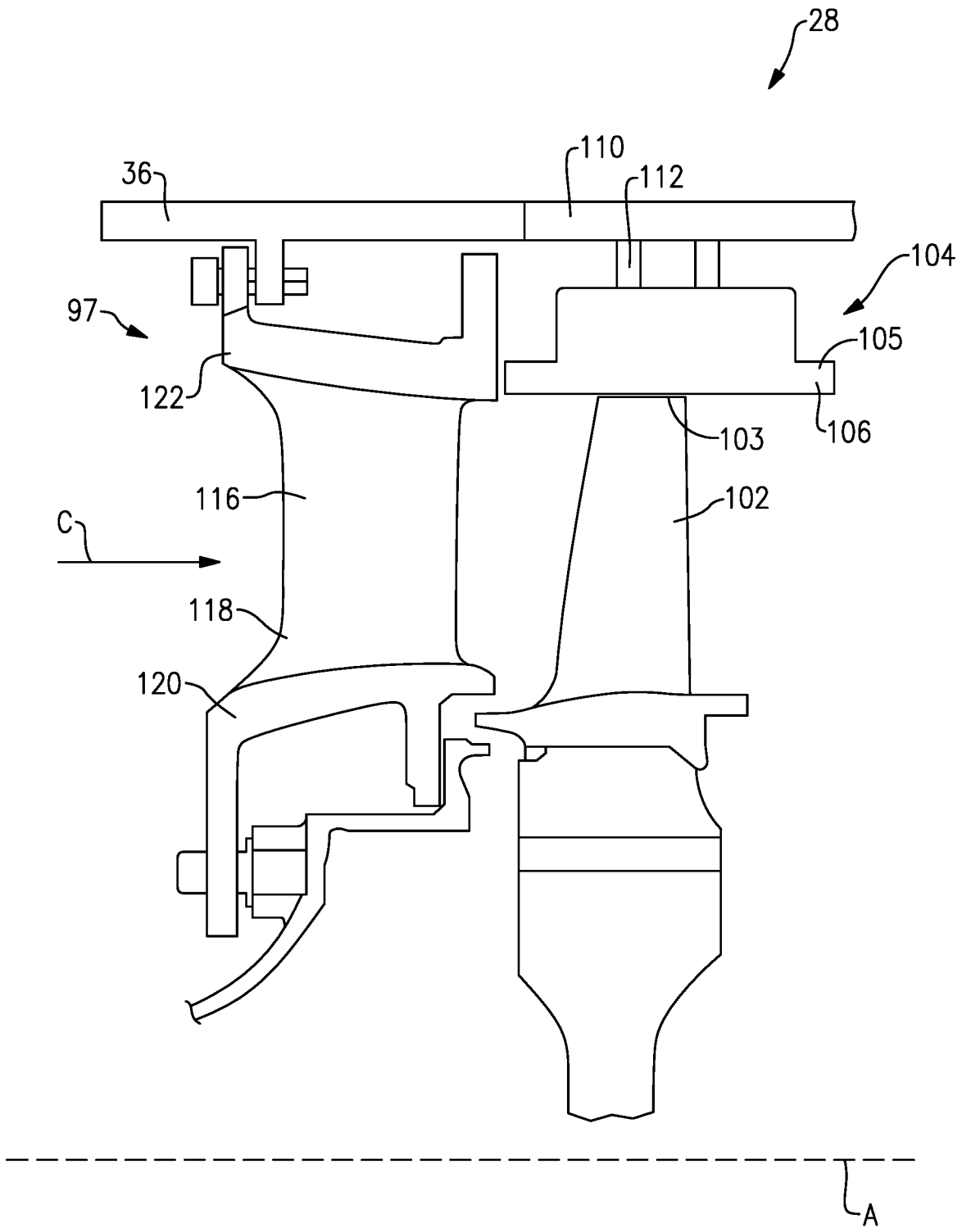
FIG. 2 schematically illustrates an example turbine section.

FIG. 2 shows a portion of an example turbine section 28, which may be incorporated into a gas turbine engine such as the one shown in FIG. 1. However, it should be understood that other sections of the gas turbine engine 20 or other gas turbine engines, and even gas turbine engines not having a fan section at all, could benefit from this disclosure. The turbine section 28 includes a plurality of alternating turbine blades 102 and turbine vanes 97.

A turbine blade 102 has a radially outer tip 103 that is spaced from a blade outer air seal assembly 104 with a blade outer air seal ("BOAS") 106. The BOAS 106 may be mounted to an engine case or structure, such as engine static structure 36 via a control ring or support structure 110 and a carrier 112. The engine structure 36 may extend for a full 360° about the engine axis A.

The turbine vane assembly 97 generally comprises a plurality of vane segments 118. In this example, each of the vane segments 118 has an airfoil 116 extending between an inner vane platform 120 and an outer vane platform 122.

Figure 3:
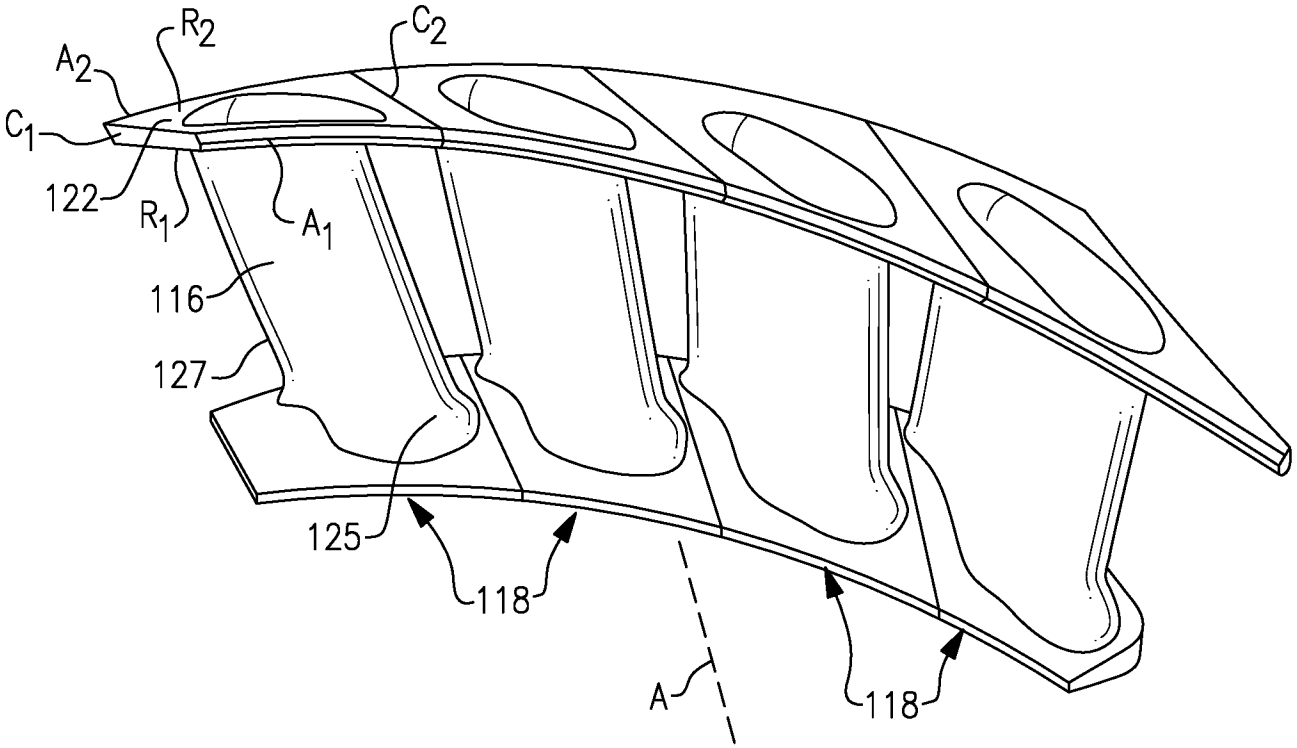
FIG. 3 illustrates a portion of a vane ring assembly.

FIG. 3 illustrates a portion of the vane ring assembly 97 from the turbine section 28 of the engine 20. The vane ring assembly 97 is made up of a plurality of vanes 118 situated in a circumferential row about the engine central axis A. Although the vane segments 118 are shown and described with reference to application in the turbine section 28, it is to be understood that the examples herein are also applicable to structural vanes in other sections of the engine 20.

The vane segment 118 has an outer platform 122 radially outward of the airfoil. Each platform 122 has radially inner and outer sides R1, R2, respectively, first and second axial sides A1, A2, respectively, and first and second circumferential sides C1, C2, respectively. The radially inner side R1 faces in a direction toward the engine central axis A. The radially inner side R1 is thus the gas path side of the outer vane platform 122 that bounds a portion of the core flow path C. The first axial side A1 faces in a forward direction toward the front of the engine 20 (i.e., toward the fan 42), and the second axial side A2 faces in an aft direction toward the rear of the engine 20 (i.e., toward the exhaust end). In other words, the first axial side A1 is near the airfoil leading end 125 and the second axial side A2 is near the airfoil trailing end 127. The first and second circumferential sides C1, C2 of each platform 122 abut circumferential sides C1, C2 of adjacent platforms 122. In this example, a mateface seal is arranged between circumferential sides C1, C2 of adjacent platforms, as will be described further herein.

Although a vane platform 122 is described, this disclosure may apply to other components, and particularly flow path components. For example, this disclosure may apply to combustor liner panels, shrouds, transition ducts, exhaust nozzle liners, blade outer air seals, or other CMC components. Further, although the outer vane platform 122 is generally shown and referenced, this disclosure may apply to the inner vane platform 120.

The vane platform 122 may be formed of a ceramic matrix composite ("CMC") material. Each platform 122 is formed of a plurality of CMC laminate sheets. The laminate sheets may be silicon carbide fibers, formed into a braided or woven fabric in each layer. In other examples, the vane platform 122 may be made of a monolithic ceramic. CMC components such as vane platforms 120 are formed by laying fiber material, such as laminate sheets or braids, in tooling, injecting a gaseous infiltrant into the tooling, and reacting to form a solid composite component. The component may be further processed by adding additional material to coat the laminate sheets. CMC components may have higher operating temperatures than components formed from other materials.

Figure 4:
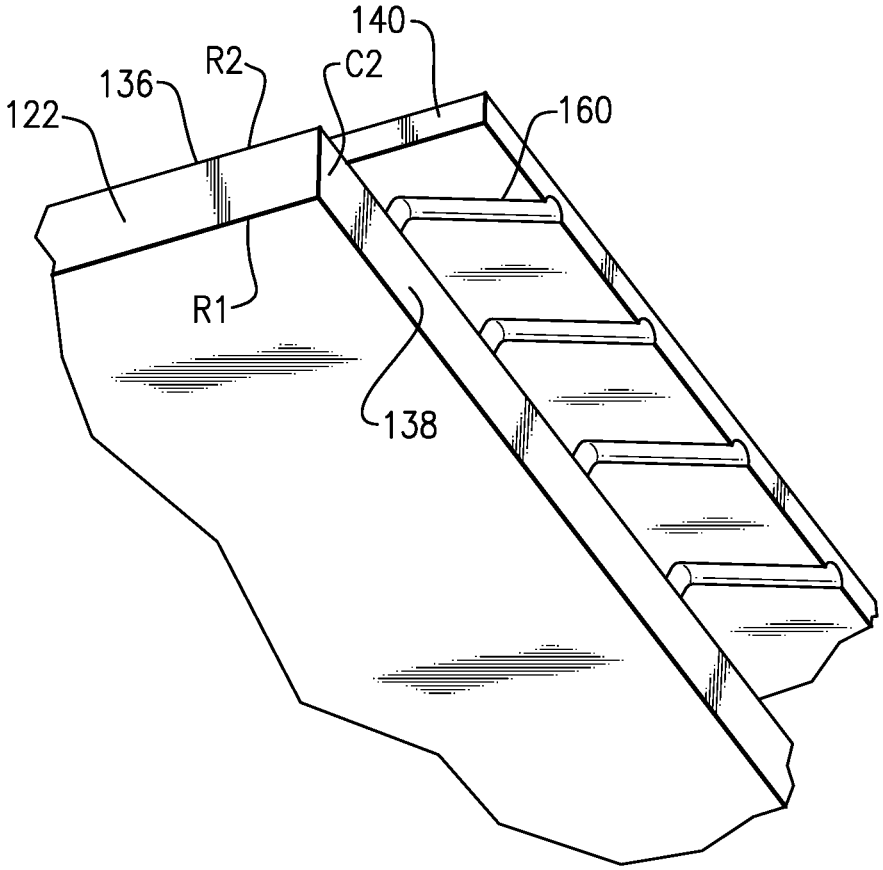
FIG. 4 illustrates a cut away view of a portion of an exemplary vane platform assembly.

FIG. 4 schematically illustrates a cut away view of an example mateface seal arrangement, such as between adjacent platforms 122. The platform 122 has a radial surface 136 and a circumferential surface 138. In this example, the radial surface 136 is the radially outer side R2 and the circumferential surface 138 is the second circumferential side C2. A mateface seal 140 is arranged on the surface 136. The mateface seal 140 has a plurality of grooves 160. The mateface seal 140 is arranged at the circumferential side C2 such that the seal 140 spans across a mateface gap 178 (shown in FIG. 5) between adjacent platforms 122. A plurality of grooves 160 are arranged in the seal 160 on a side that abuts that surface 136. Cooling air flows through the grooves 160 to cool the seal 140 and the surfaces 136 and 138.

The mateface seal 140 may be a metallic component such as a cobalt material, for example. The mateface seal 140 may be biased into engagement with the surface 136 via a separate assembly. In one example, a spring assembly (not shown) is used to hold the mateface seal 140 in the proper location.

Figure 5:
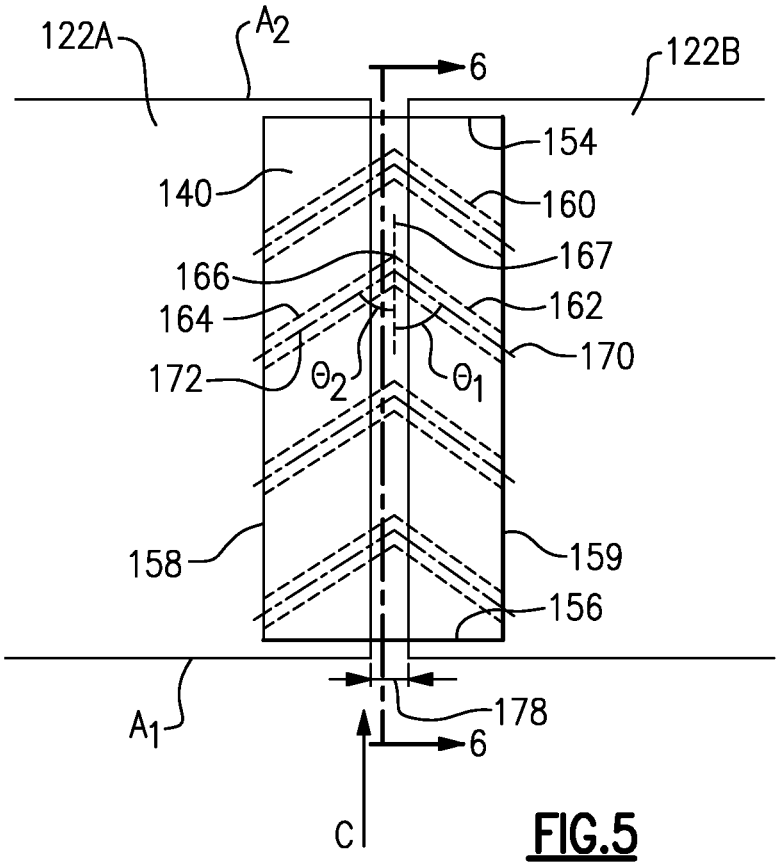
FIG. 5 illustrates a portion of the exemplary vane platform assembly.

FIG. 5 schematically illustrates a view of the mateface seal arranged between two platforms 122A, 122B. The plurality of grooves 160 are arranged in a chevron pattern. Each groove 160 has a first leg 162 and a second leg 164 that meet at a point 166. Thus, each groove 160 forms a chevron or V-shape. The point 166 is substantially centered on the seal 140 in the circumferential direction. The first legs 162 of each groove 160 are substantially parallel to one another and the second legs 164 of each groove 160 are substantially parallel to one another. In the example seal 140, the first and second lets 162, 164 are straight. However, in other embodiments, the legs 162, 164 may have another arrangement, such as wavy or curved for example.

A plane 167 is defined at the circumferential center of the seal 140, extending from a first axial side 156 to a second axial side 154 of the seal 140. The first leg 162 of each groove is centered on an axis 170 and the second leg 164 of each groove 160 is centered on an axis 172. The axes 170, 172 are each are arranged at an angle $\theta_1$, $\theta_2$, respectively, with respect to the plane 167. The angles $\theta_1$, $\theta_2$ may be equal to one another. In one example, the angles $\theta_1$, $\theta_2$ are both about 45°. The angles $\theta_1$, $\theta_2$ may be between about 20° and about 70°, for example. The first leg 162 has a same length as the second leg 164, for example. Although four grooves 160 are illustrated, the seal 140 may have more or fewer grooves 160, depending on the length of the seal 140.

Figure 6:
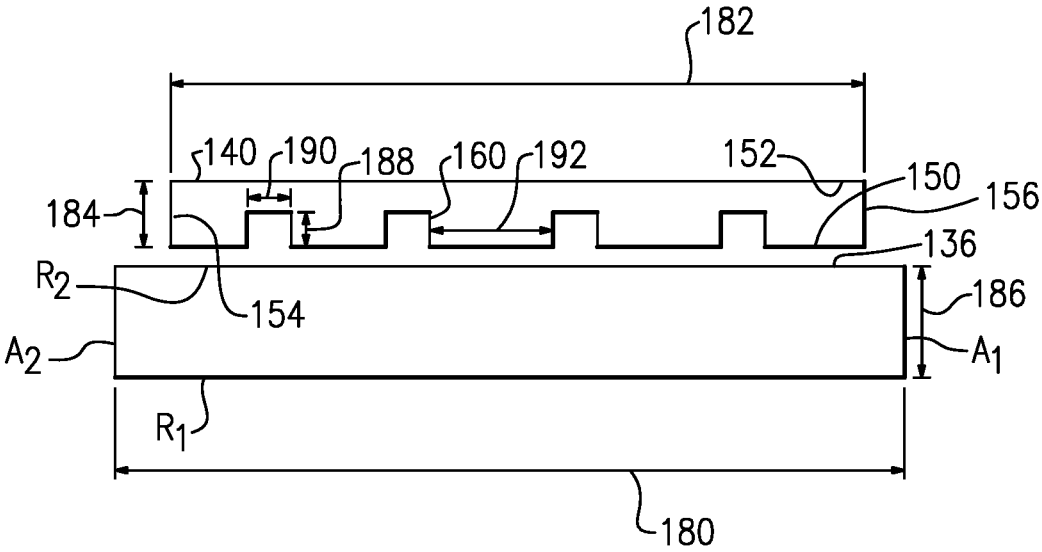
FIG. 6 illustrates a cross-sectional view of the portion of the exemplary vane platform assembly.

FIG. 6 illustrates a cross-sectional view along line 6-6 of FIG. 5. Each of the grooves 160 is spaced apart by a distance 192. In one example, the grooves 160 are evenly spaced apart from one another. In this view, the cooling air will flow in a direction out of the page toward the surface 138, and then radially inward through the gap 178 to the core flow path C.

Each of the grooves 160 has a width 190 and a height 188. The height 188 is smaller than a thickness 184 of the seal 140. In this example, the width 190 is smaller than a distance 192 between adjacent grooves 160. Although rectangular grooves 160 are shown, the grooves 160 may have another shape, such as rounded or triangular, in some examples. In the illustrated example, the thickness 184 of the seal 140 is smaller than a thickness 186 between the first and second radial sides R1, R2 of the platform 122. A length 182 of the seal 140 in the axial direction may be shorter than a length 180 between the first and second axial sides A1, A2 of the platform 122. However, the length 182 spans most of the length 180 of the platform 122.

The mateface seal 140 helps to prevent leakage of cooling air through a gap 178 between circumferential sides C1, C2 of adjacent platforms 122A, 122B. The leakage of cooling air may come from outboard of the platform 122, such as from a vane cavity. The grooves 160 provide controlled leakage that helps to cool the mateface seal 140. The size of the grooves 160 and the number of grooves 160, and the distance 192 between grooves 160 may vary, depending on the size of the mateface seal 140 and the amount of cooling of the mateface seal 140 needed.

Mateface seals are used to limit cooling air leakage to the core flow path, which may improve engine efficiency. Known mateface seals may be susceptible to overheating because of their proximity to the core flow path C. Further, CMC components have higher temperature capabilities, and thus mateface seals used with CMC components may be exposed to higher temperatures. The disclosed arrangement provides grooves 160 that allow a controlled amount of cooling air to flow through the mateface seal 140 and mateface gap 178 to cool both the mateface seal 140 and circumferential surfaces 138 of the platform 122. The angled grooves 160 may provide a better injection angle of the leakage into the core flowpath C, which may improve efficiency. The chevron arrangement of angled grooves 160 also provide a longer groove 160 for improved cooling performance.

In this disclosure, "generally axially" means a direction having a vector component in the axial direction that is greater than a vector component in the circumferential direction, "generally radially" means a direction having a vector component in the radial direction that is greater than a vector component in the axial direction and "generally circumferentially" means a direction having a vector component in the circumferential direction that is greater than a vector component in the axial direction.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A flow path component assembly, comprising:
a flow path component having a plurality of segments extending circumferentially about an axis;
each of the segments having a first radial side and a second radial side and extending in a circumferential direction from a first circumferential side to a second circumferential side relative to the axis; and
wherein a respective mateface seal is arranged on the first radial side near the first circumferential side of each of the segments, the mateface seal having at least one v-shaped groove;
wherein the at least one v-shaped groove is formed from a first leg and a second leg that meet at a point, the point is circumferentially aligned with a mateface gap established between the first circumferential side and the second circumferential side of an adjacent one of the segments relative to the circumferential direction, and the point is centered on the mateface seal in the circumferential direction.

2. The flow path component assembly of claim 1, wherein the first radial side is a radially outer side.

3. The flow path component assembly of claim 1, wherein the at least one v-shaped groove is a plurality of v-shaped grooves.

4. The flow path component assembly of claim 3, wherein the plurality of v-shaped grooves are evenly spaced from one another.

5. The flow path component of claim 3, wherein cooling air is configured to flow through each of the v-shaped grooves and then into the mateface gap, each of the v-shaped grooves has a width, and the width is smaller than a distance between adjacent grooves of the plurality of v-shaped grooves in an axial direction relative to the axis.

6. The flow path component assembly of claim 1, wherein the first and second legs have a same length as one another.

7. The flow path component assembly of claim 1, wherein the at least one v-shaped groove is arranged in a side of the mateface seal that abuts the first radial side.

8. The flow path component assembly of claim 7, wherein cooling air is configured to flow through the at least one v-shaped groove.

9. The flow path component assembly of claim 1, wherein the mateface seal comprises a metallic material.

10. The flow path component assembly of claim 1, wherein the mateface seals are arranged between respective pairs of the plurality of segments about the axis.

11. The flow path component assembly of claim 1, wherein each of the segments is a vane platform.

12. The flow path component assembly of claim 1, wherein each of the segments is formed from a ceramic material.

13. A turbine section for a gas turbine engine, comprising:

a plurality of vanes arranged circumferentially about an engine axis, each vane having a platform, the plurality of vanes including a first vane and a second vane, and the platform of the first vane being spaced apart from the platform of the second vane in a circumferential direction relative to the engine axis; and each of the platforms having a first radial side and a second radial side and extending in the circumferential direction from a first circumferential side to a second circumferential side, and a mateface gap established between the first circumferential side of the platform of the first vane and the second circumferential side of the platform of the second vane; and a mateface seal arranged on the first radial side near the first circumferential side of the platform of the first vane and the second circumferential side of the platform of the second vane such that the mateface seal spans across the mateface gap, the mateface seal having at least one v-shaped groove formed from a first leg and a second leg that meet at a point, wherein the point is circumferentially aligned with the mateface gap, and the point is centered on the mateface seal in the circumferential direction.

14. The turbine section of claim 13, wherein the at least one v-shaped groove includes a plurality of v-shaped grooves.

15. The turbine section of claim 13, wherein the at least one v-shaped groove is arranged such that the point of the v-shape points in a direction of core air flow through a core flow path of the gas turbine engine, and the second radial side bounds the core flow path.

16. The turbine section of claim 13, wherein the first radial side is a radially outer side.

17. The turbine section of claim 13, wherein cooling air is configured to flow through the at least one v-shaped groove to the mateface gap.

18. The turbine section of claim 13, wherein at least one of the platforms is formed from a ceramic material.

19. The turbine section of claim 13, wherein:

each of the platforms comprises a ceramic matrix composite, and the mateface seal comprises a metallic material;

each of the platforms extends in an aft direction from a first axial side to a second axial side relative to the engine axis, the first axial side being forward of the second axial side relative to the engine axis; and the at least one v-shaped groove includes a plurality of v-shaped grooves distributed in an axial direction relative to the engine axis, and each of the v-shaped grooves is arranged such that the point of the v-shape groove faces in the aft direction.

20. The turbine section of claim 19, wherein each of the v-shaped grooves has a width, and the width is smaller than a distance between adjacent grooves of the plurality of v-shaped grooves relative to the axial direction.

* * * * *